US005755100A

United States Patent [19]

Lamos

[11] Patent Number: 5,755,100

[45] Date of Patent: May 26, 1998

[54] HERMETICALLY SEALED STIRLING ENGINE GENERATOR

[75] Inventor: Richard A. Lamos, Christiansted, Virgin Islands (U.S.)

[73] Assignee: Stirling Marine Power Limited, St. Croix, Virgin Islands (U.S.)

[21] Appl. No.: 823,349

[22] Filed: Mar. 24, 1997

[51] Int. Cl.[6] ..... F01B 29/10

[52] U.S. Cl. ..... 60/521; 603/524

[58] Field of Search ..... 60/521, 524, 526

[56] References Cited

U.S. PATENT DOCUMENTS

| | | | |
|---|---|---|---|
| 3,492,324 | 1/1970 | Johansson et al. | 60/524 |
| 3,813,881 | 6/1974 | Neelen | 60/521 |
| 3,999,388 | 12/1976 | Nystrom | 60/521 |
| 4,179,891 | 12/1979 | Gronvall | 60/521 |
| 4,253,303 | 3/1981 | Liljequist | 60/517 |
| 4,511,805 | 4/1985 | Boy-Marcotte | 290/1 |
| 4,765,138 | 8/1988 | Corey | 60/517 |
| 5,329,768 | 7/1994 | Moscrip | 60/518 |

*Primary Examiner*—Noah P. Kamen

[57] ABSTRACT

A hermetically sealed Stirling engine driven generator system with a rotating generator, self lubricated bearings using PTFE filled polyimide, a fibrous ceramic piston dome, and flame sprayed ceramic and PTFE coating on the pistons, which allow an oil free system. A brushless self starting system is also used as an alternator. A simple working gas pressure control system uses the housing for the generator and the crankcase as a reservoir for working gas allowing a single valve working in conjunction with a small compressor to regulate the pressure of the working gas.

20 Claims, 7 Drawing Sheets

HERMETICALLY SEALED STIRLING ENGINE GENERATOR

BACKGROUND—FIELD OF INVENTION

The present invention relates to a Stirling engine, and more particularly to a hermetically sealed unit suitable for use in producing electricity.

BACKGROUND—DISCUSSION OF PRIOR ART

The Stirling engine is an external combustion engine that converts heat into driving power by continuous heating and cooling of a captive gas. The engine operates on the principle that a gas (in this case helium) expands when heated and contracts when cooled. Many different embodiments have been disclosed in the past including swashplate drives, rhombic drives, free piston engines, and more. The simplest design remains the standard crankshaft driving two pistons contained within cylinders positioned ninety degrees from each other. A variety of heat sources can be used, the most common is an external combustion chamber in which a combustible fuel is burned in an abundance of air at atmospheric pressure. There is no debris or unburned fuel to be disposed of, and there are no byproducts of combustion coming into contact with the moving parts of the engine. Heater tubes within the combustion chamber are connected to the cylinders and to a water cooled heat exchanger. This closed system contains helium, the working gas, which moves back and forth between the combustion chamber and the heat exchanger where heat is rejected to the cooling system water. This action of heating and cooling the helium changes its pressure and exerts a force on the pistons that drive the crankshaft. To control the speed, the Stirling engine has two control systems. The first control keeps the temperature of the working gas at a constant value by varying the air flow and the fuel flow. The second control system maintains a constant speed by opening and closing valves that regulate the pressure of the working gas.

Previously, all embodiments of the Stirling engine have had problems that have prevented them from being viable products. All systems that utilize an output shaft as their way of extracting work from the engine have a difficult problem in sealing the high pressure working gas (helium or hydrogen) within the system. Previous embodiments have tried techniques such as using a cross head with a cylindrical piston shaft which is sealed. This seal requires lubricating oil to be pumped against the seal to retard the leakage of the gas and to lubricate the seal. This presents the problem of oil contamination of the working gas. U.S. Pat. No. 4,765,138 to Corey (1988) discloses a pressurized crankcase to eliminate the cross heads and connecting rods. This system, however, just moves the problem to the crankshaft where seals are required. It also requires that the crankshaft be cooled to prevent the deterioration of the connecting rod bearings.

U.S. Pat. No. 4,511,805 to Boy-Marcotte et al. (1985) discloses a "free piston" Stirling engine in which the pistons are coupled to a linear alternator and the system is hermetically sealed. The free piston system is difficult to counterbalance and requires complex electromagnetic coupling and control systems as is witnessed by U.S. Pat. No. 5,329,768 to Moscrip (1994). It is also limited by the mass of the linear alternator which must be constantly accelerated and decelerated back and forth, and there are no commercially available alternators of this type. Another embodiment is shown in U.S. Pat. No. 4,253,303 to Liljequist (1981) which uses a bellows arrangement to seal in the working gas. This system is impractical in that the working pressure of the gas must be kept low to minimize stress on the bellows which greatly reduces the efficiency of the engine. The output of the engine is also linear which is impractical to use for productive work.

Previous embodiments of the Stirling engine have required complex control systems to maintain their speed over a range of load conditions. Systems which have dynamic seals need to have a reservoir of helium or hydrogen to make up for losses during running and to reduce pressure so that leakage is minimized when the engine is not running. These reservoirs require valves and piping to allow the gas to be moved to and from the engine, adding to the cost and complexity of the system.

OBJECTS AND ADVANTAGES

It is, therefore, an object of the present invention to provide an improved Stirling engine powered generator system with a simplified design including a hermetically sealed housing containing all that is necessary for self starting and the production of electricity, and provides a reservoir for the working gas which eliminates the problems of sealing in the working gas. Another advantage of the present invention is the elimination of lubricating oil by the use of a combination of new materials.

It is another object of the present invention to provide a system for speed control, thus regulating the frequency of the electrical output, which is simplified and less costly to produce. It is a further object of this invention to provide a highly reliable, quiet, low vibration system with all the other advantages of the Stirling engine technology.

Additional benefits and advantages of the present invention will become apparent to those skilled in the art to which this invention relates from the following description of the preferred embodiments and the claims, taken in conjunction with the accompanying drawings.

Reference Numerals in the Drawings

| | |
|---|---|
| 10 | crankcase |
| 12 | expansion piston |
| 14 | compression piston |
| 16 | crankshaft |
| 18 | connecting rod |

-continued

| | |
|---|---|
| 20 | cooler |
| 22 | regenerator |
| 24 | igniter |
| 26 | vaporization tube |
| 28 | air deflector |
| 30 | recuperator |
| 32 | heater assembly |
| 34 | compression cylinder |
| 36 | expansion cylinder |
| 38 | compressor piston |
| 40 | ball valve |
| 42 | compressor rod |
| 44 | compressor spring |
| 46 | compressor wrist pin |
| 48 | compressor head |
| 50 | compressor valve |
| 52 | pressure control valve |
| 54 | pressure control tube |
| 56 | compressor tube |
| 58 | air inlet duct |
| 60 | exhaust duct |
| 62 | wrist pin |
| 64 | liner |
| 66 | cylinder gasket |
| 68 | cooler end caps |
| 70 | piston rings |
| 72 | connecting rod bearings |
| 74 | dome |
| 76 | head gasket |
| 78 | main bearing |
| 80 | bearing plate |
| 82 | speed sensor |
| 84 | speed sensor disk |
| 86 | fuel injector |
| 88 | bell housing |
| 90 | starter stator |
| 92 | starter rotor |
| 94 | flywheel |
| 96 | generator armature |
| 98 | generator stator |
| 100 | generator cooling tubes |
| 102 | generator housing |
| 104 | temperature sensor |
| 106 | ceiling |

DETAILED DESCRIPTION OF THE INVENTION

Figure 1:
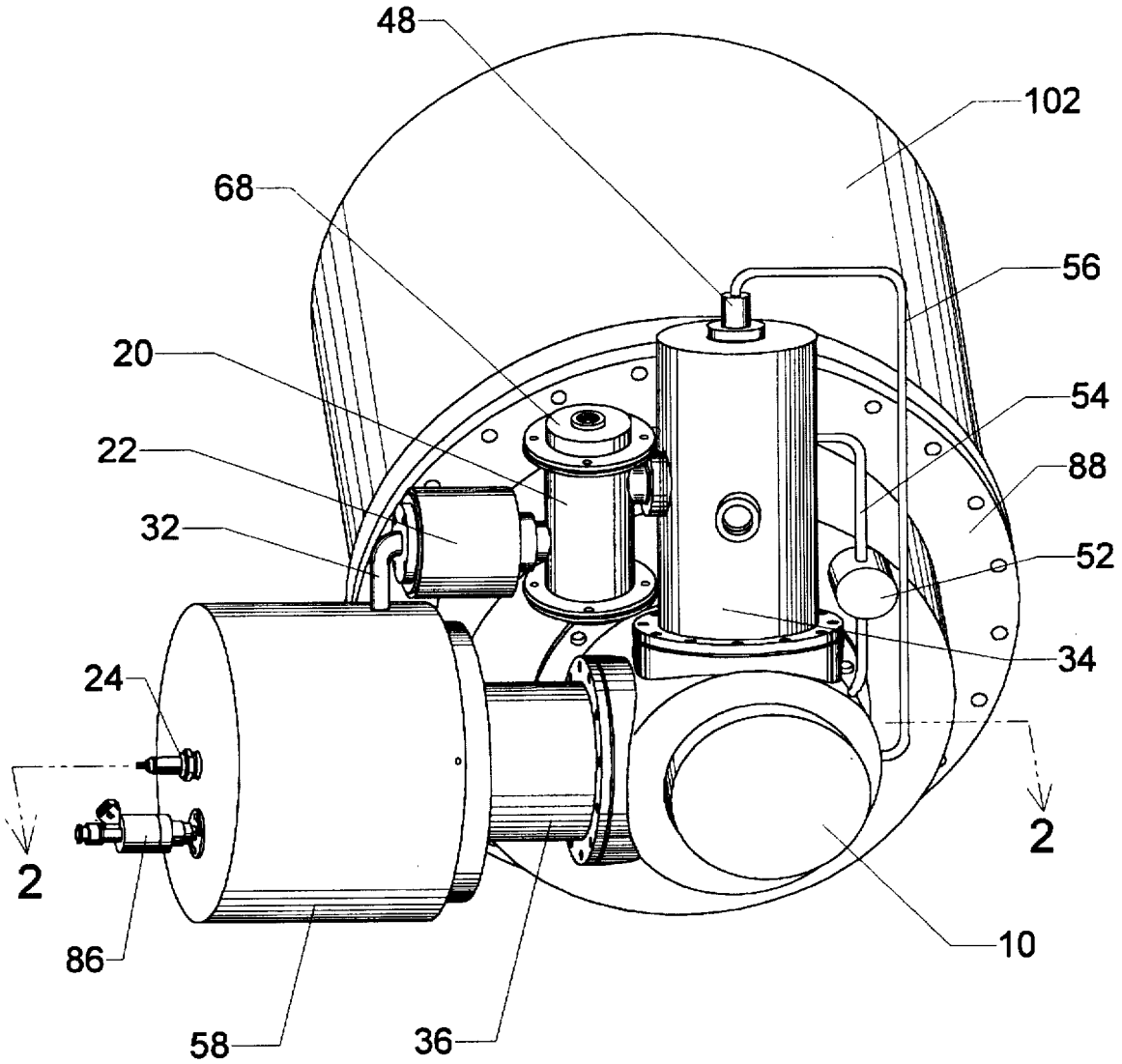
FIG. 1 is an overall perspective view of an embodiment of a Stirling engine driven generator system in accordance with the present invention.

The preferred embodiment of this invention is shown in perspective view in FIG. 1. It consists of a crankcase 10 which supports an expansion cylinder 36 and a compression cylinder 34. The axis of these cylinders are substantially 90 degrees from each other. FIG. 1 also shows a bell housing 88 attached and sealed to the crankcase 10. Attached and sealed to the bell housing 88 is a generator housing 102.

Figure 2:
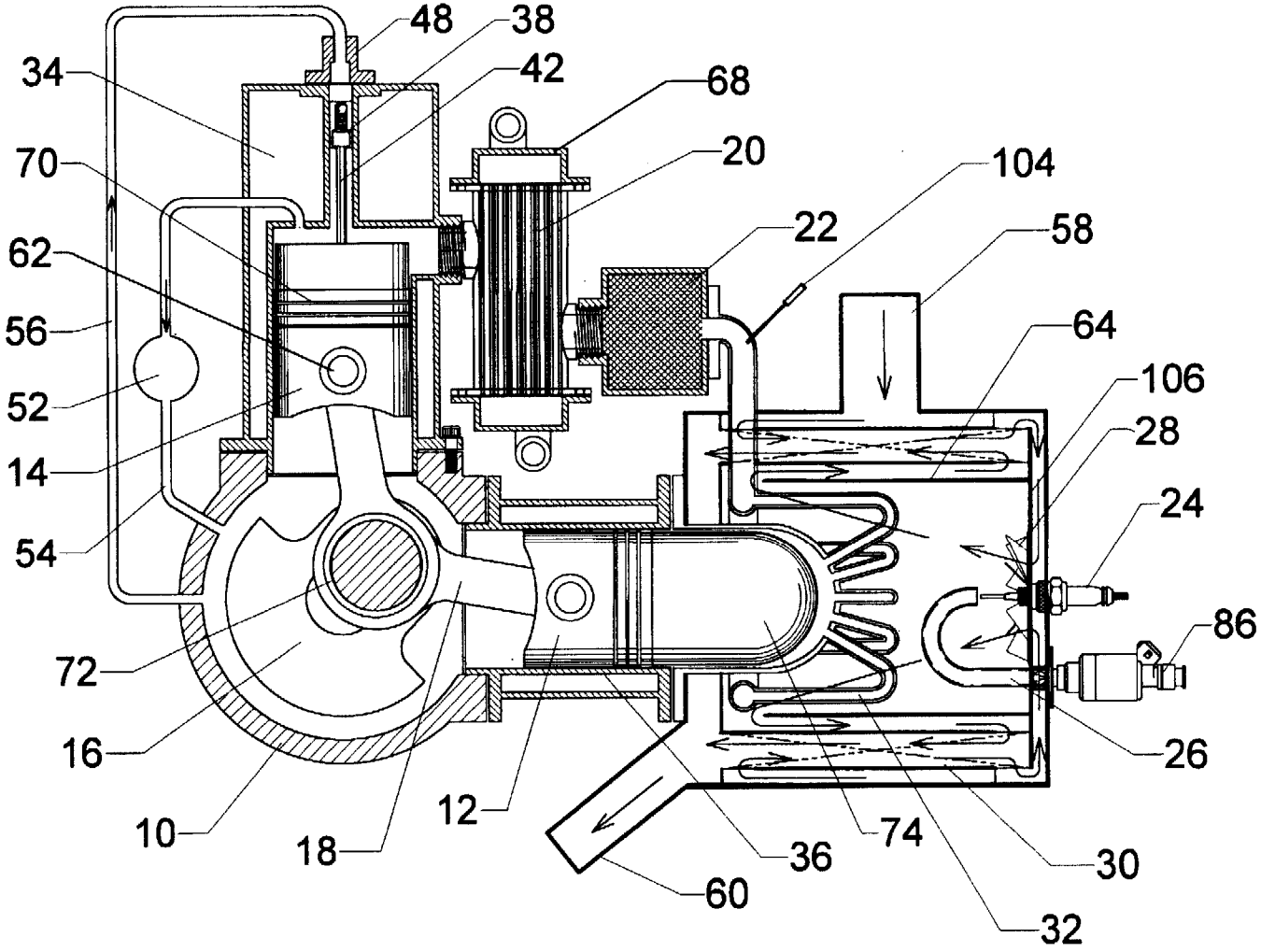
FIG. 2 is a sectional view of the major components of an embodiment of the Stirling engine of the present invention.

FIG. 2 is a sectional view cut through the crankcase 10, the expansion cylinder 36, and the compression cylinder 34. The expansion cylinder is jacketed such that cooling water can be circulated around it. The compression cylinder 34 is made up of two regions which are cylindrical and co-linear. One of these regions is significantly smaller in diameter than the other. This assembly is also water jacketed to accommodate cooling water. Fastened to the top of the compression cylinder 34 is a compressor head 48. A cooler 20 is also attached to compression cylinder 20 in such a way as to allow the passage of a pressurized working gaseous fluid between them. The cooler 20 is fitted with internal cooling passages and with end caps 68 though which water can pass, forming a heat exchanger to transfer heat form the working gas to the water. Connected to the cooler is a regenerator 22 which is filled with metallic filaments and provides a passageway from the cooler to a heater assembly 32. This heater assembly is made up of a multiplicity of tubes and an annular passageway which are integrally welded to a domed shaped section. This heater assembly 32 is also connected to the expansion cylinder 36.

A compressor tube 56 is connected between the crankcase 10 and the compressor head 48 in such a way as to form a gas-tight passageway between them. A pressure control tube is connected between the crankcase 10 and the upper end of the larger diameter region of the compression cylinder 34. The pressure control tube 54 contains a pressure control valve 52.

Within the crankcase 10 is a crankshaft 16 onto which are connected two connecting rods 18 which share a common journal. Two wrist pins 62 connect rods 18 to a compression piston 14 and a expansion piston 12. A multiple of piston rings 70 are fitted within grooves in the compression piston 14 and the expansion piston 12, forming a sufficiently tight seal as to greatly restrict the passage of high pressure gas between the inner walls of the cylinders and the pistons. Rigidly attached to expansion piston 12 is a fibrous ceramic dome 74.

Surrounding the heater assembly 32, is a burner assembly consisting of a cylindrical liner 64, a recuperator 30, an air inlet duct 58, and an exhaust duct 60. A vaporization tube 26 consists of a curved hollow tube which passes through and is welded to a flat sheet metal ceiling 106 which forms the right end of a combustion chamber. The ceiling 106 is fitted with a hole through its center through which air can pass. Attached to ceiling 106 at this point is an air deflector 28 which is made up of angularly arranged vanes which cause a swirling of the air that passes through the opening in the ceiling 106. An igniter 24 is screwed into a hole in the center of the air deflector 28 in such a manner as to provide a spark gap between the electrode of the igniter 24 and the vaporization tube 26. A solenoid type electronic fuel injector 86 is attached to inlet air duct 58 and projects through a hole within it such that the discharge end is inline with the vaporization tube 26.

Figure 3:
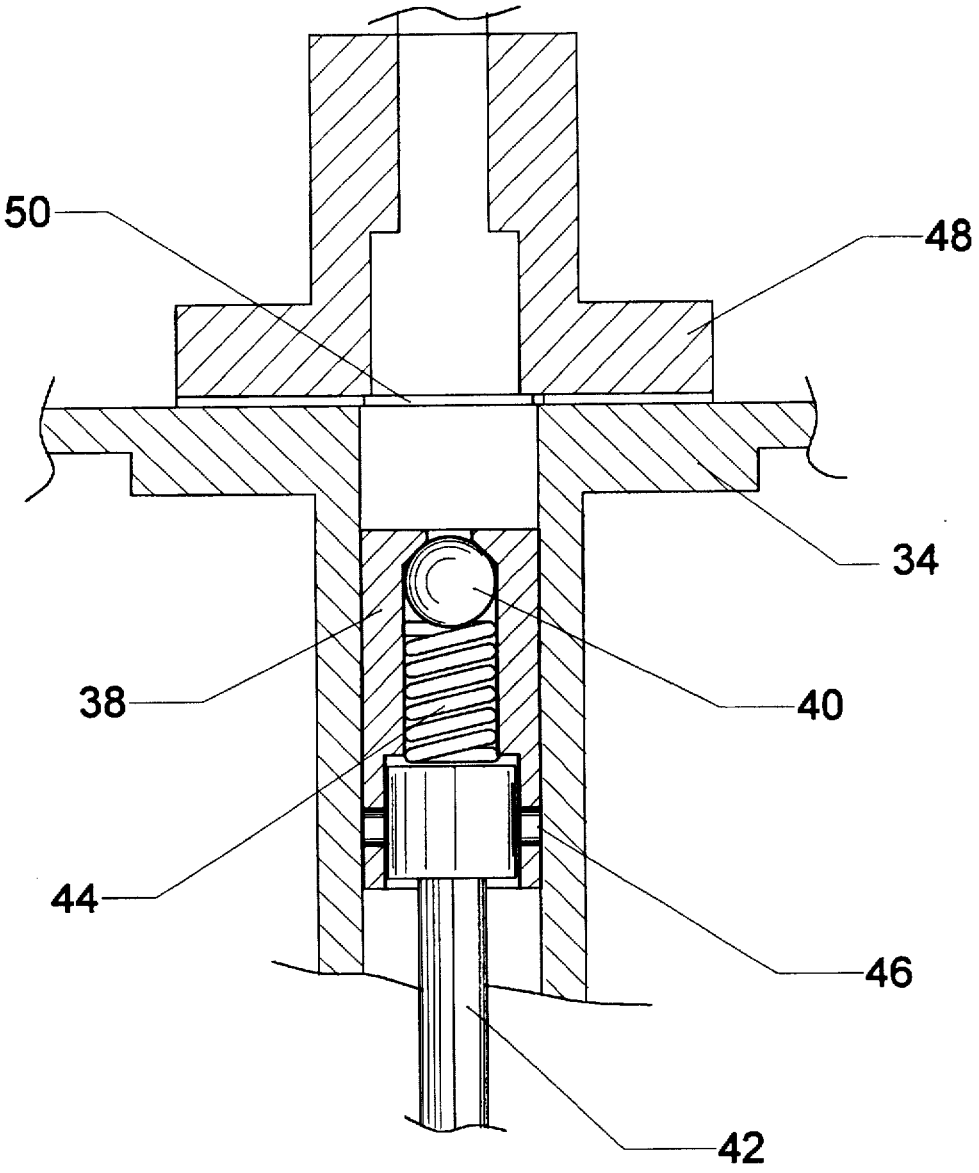
FIG. 3 is an enlarged partial sectional view of the compressor of FIG. 2.

Attached to the compression piston 14 is a compressor piston 38, via a compressor rod 42. FIG. 3 shows an enlarged sectional view of the compressor piston 38 and its associated parts which are contained in a cylindrical passageway which is contained within the compression cylinder 34. Compressor piston 38 is connected to compressor rod 42 by a compressor wrist pin 46. A ball valve 40 is held against a tapered seating surface within compressor piston 38 by a compressor spring 44. There is a small hole through the end of the compressor piston 38 such that a one-way valve is formed which allows working gas to pass downward through the piston and into the space below it, but not upward through the compressor piston 38. A compressor valve 50 is sandwiched between the compressor head 48 and the compression cylinder 34. This compressor valve 50 is a thin reed type valve which is positioned in a way such that it allows the passage of the working gas downward through the compressor head 48 into the space above compressor piston 38, but not upwardly through the compressor head 48.

Figure 4:
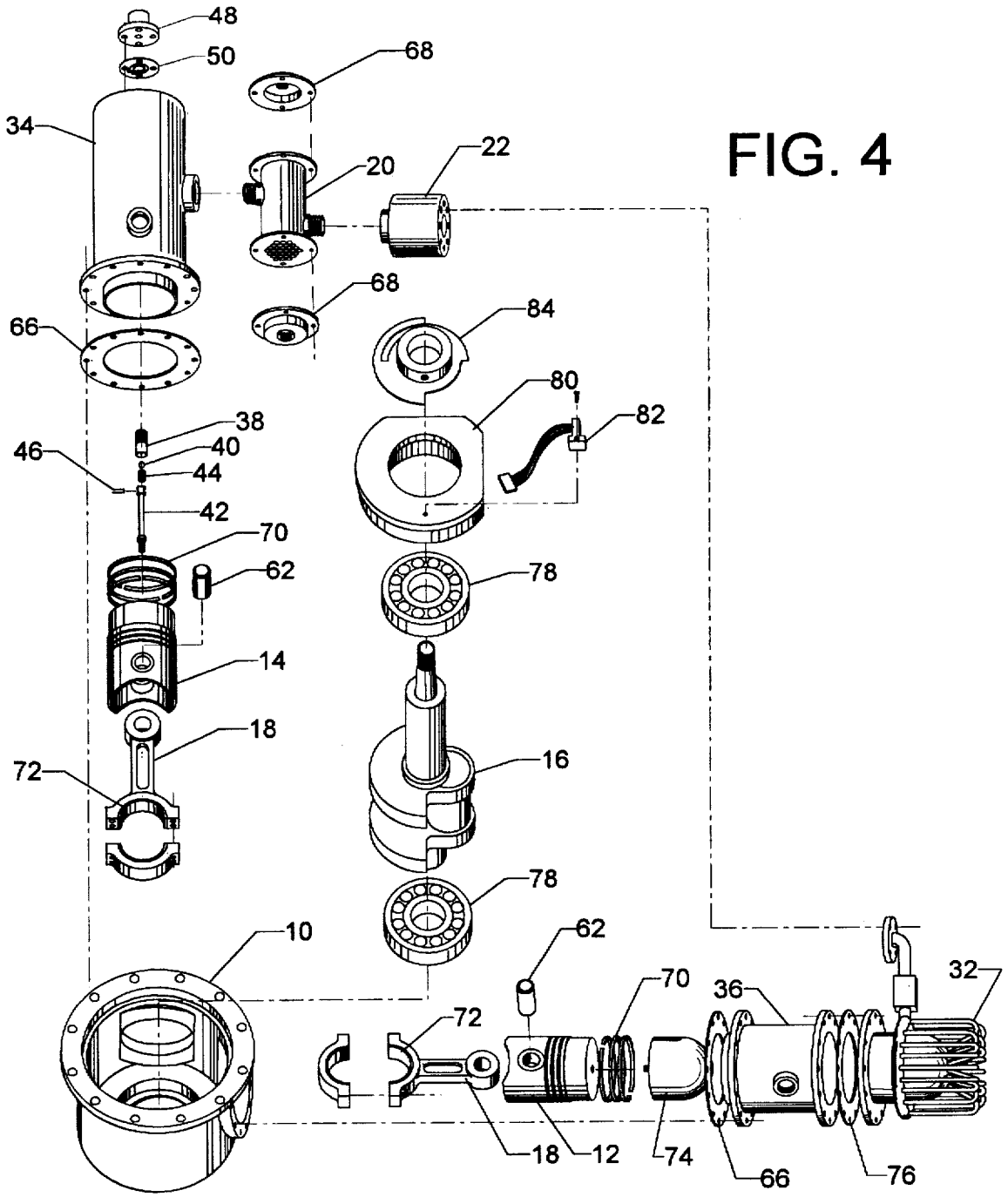
FIG. 4 is an exploded isometric view of the Stirling engine of FIG. 2 less the burner components.

FIG. 4 is an exploded isometric view of the Stirling engine of FIG. 2 without the burner parts. Also seen in FIG. 4 are two cylinder gaskets 66 which form a gas-tight seal between the crankcase 10 and the compression cylinder 34, and between the expansion cylinder 36 and the crankcase 10. A head gasket 76 forms a gas-tight seal between the expansion cylinder 36 and the heater assembly 32. This head gasket 76 is made of a synthetic asbestos-like material which acts as a thermal insulator. The crankshaft 16 is supported by two main bearings 78, one of which is supported by a bearing plate 80, and the other is fitted within crankcase 10. An optical speed sensor 82 is mounted on the bearing plate 80. A speed sensor disk is attached to the crankshaft 16 such that it works in conjunction with the speed sensor 82.

Figure 5:
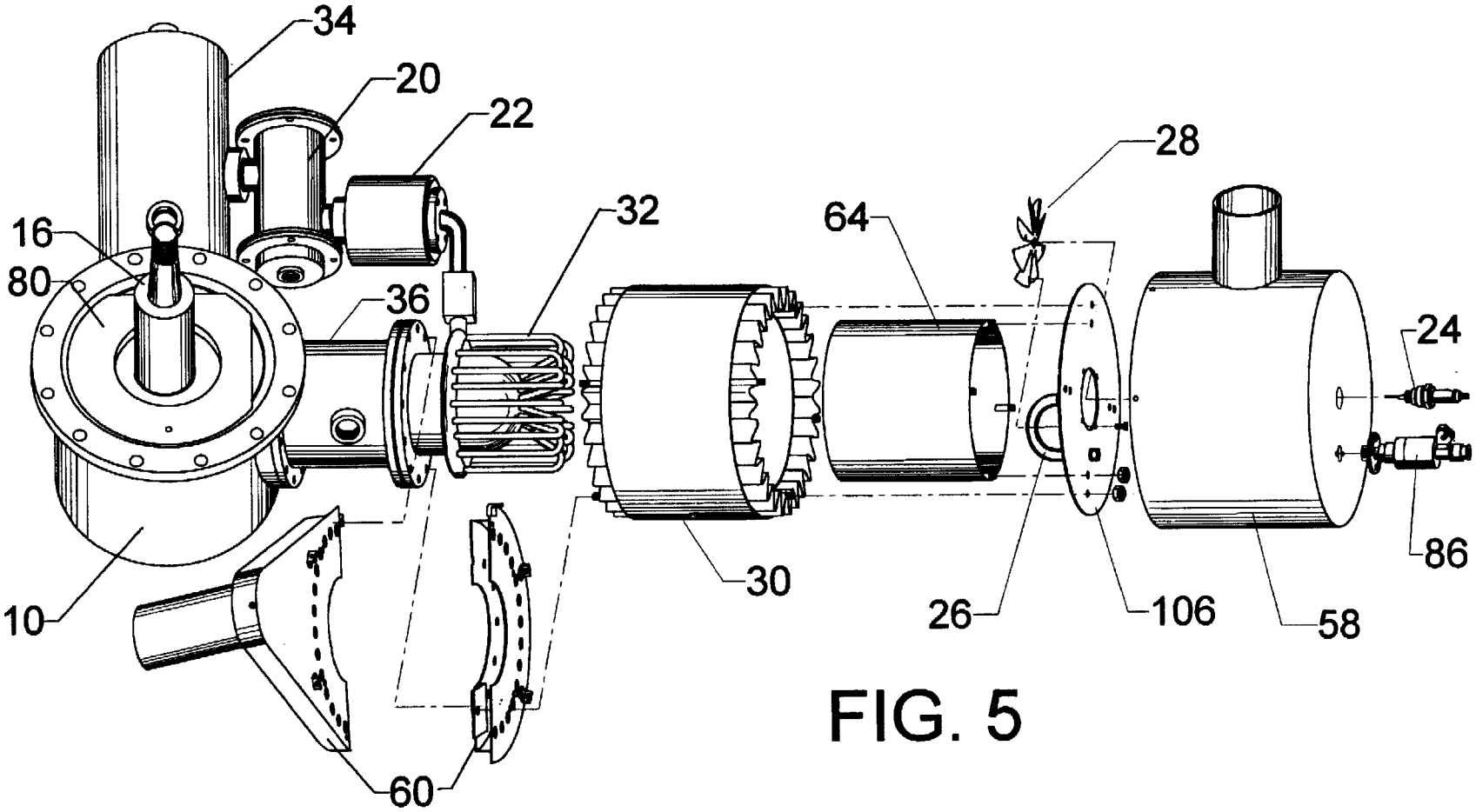
FIG. 5 is an exploded isometric view of the burner components and the assembled Stirling engine of FIG. 2.

FIG. 5 shows the Stirling engine of FIG. 4 along with an exploded isometric view of the burner parts. The exhaust duct 60 is provided in two halves so that it can be fitted around the heater assembly 32 and forms a manifold for collecting the exhaust gasses. Recuperator 30 is made up of a hollow cylindrical inner shell, a hollow cylindrical outer shell and a corrugated sheet metal piece which fills the gap between the two shells.

Figure 6:
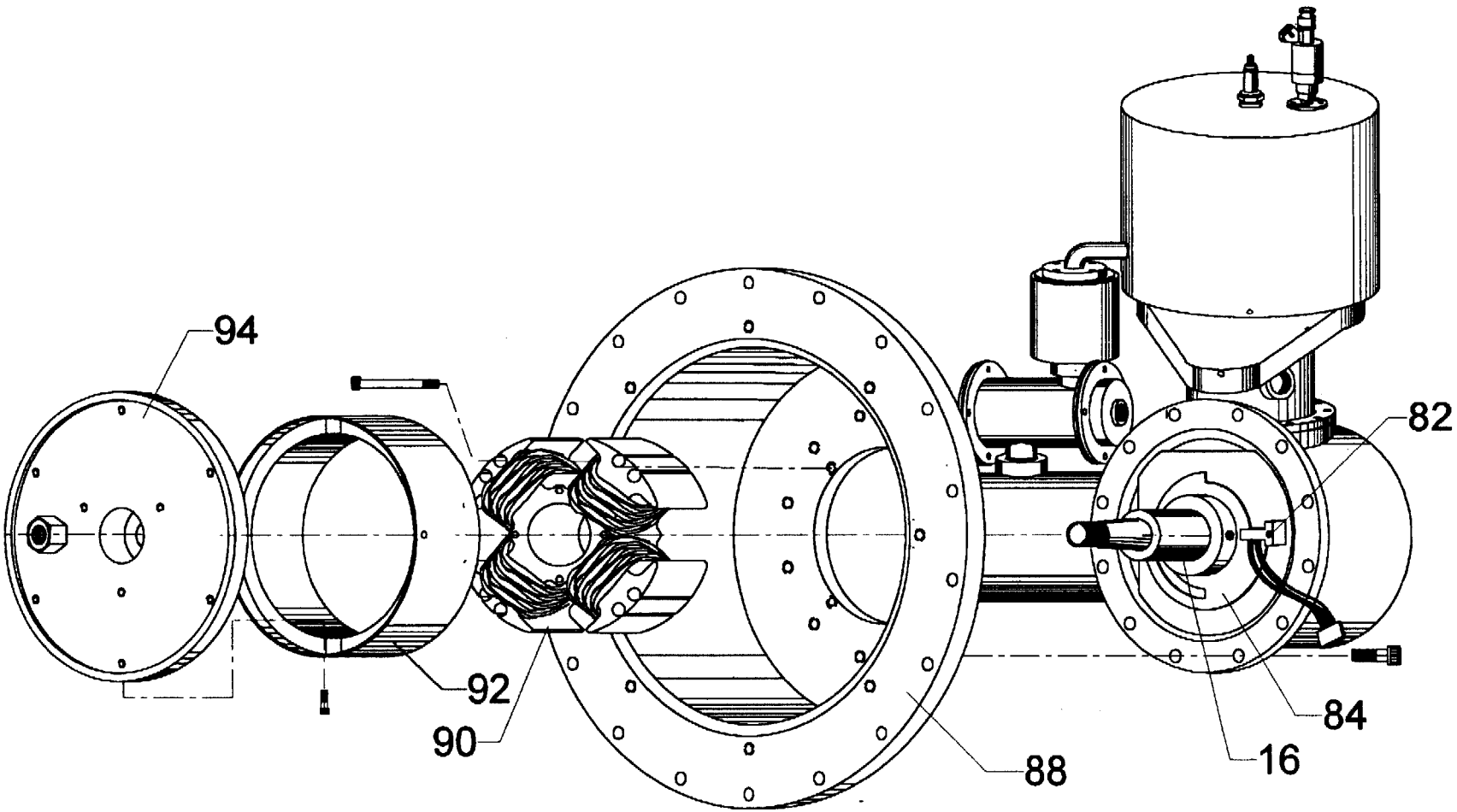
FIG. 6 is an isometric view of the Stirling engine of FIG. 2 with an exploded view of the starter components and bell housing of the generator system of FIG. 1.

FIG. 6 shows the Stirling engine assembly of FIG. 5 along with an exploded isometric view of the bell housing 88 and a starter assembly made up of a starter stator 90, which is fastened to the bell housing 88, and a starter rotor 92 which is fastened to a flywheel 94. The flywheel 94 is fastened to the crankshaft 16.

Figure 7:
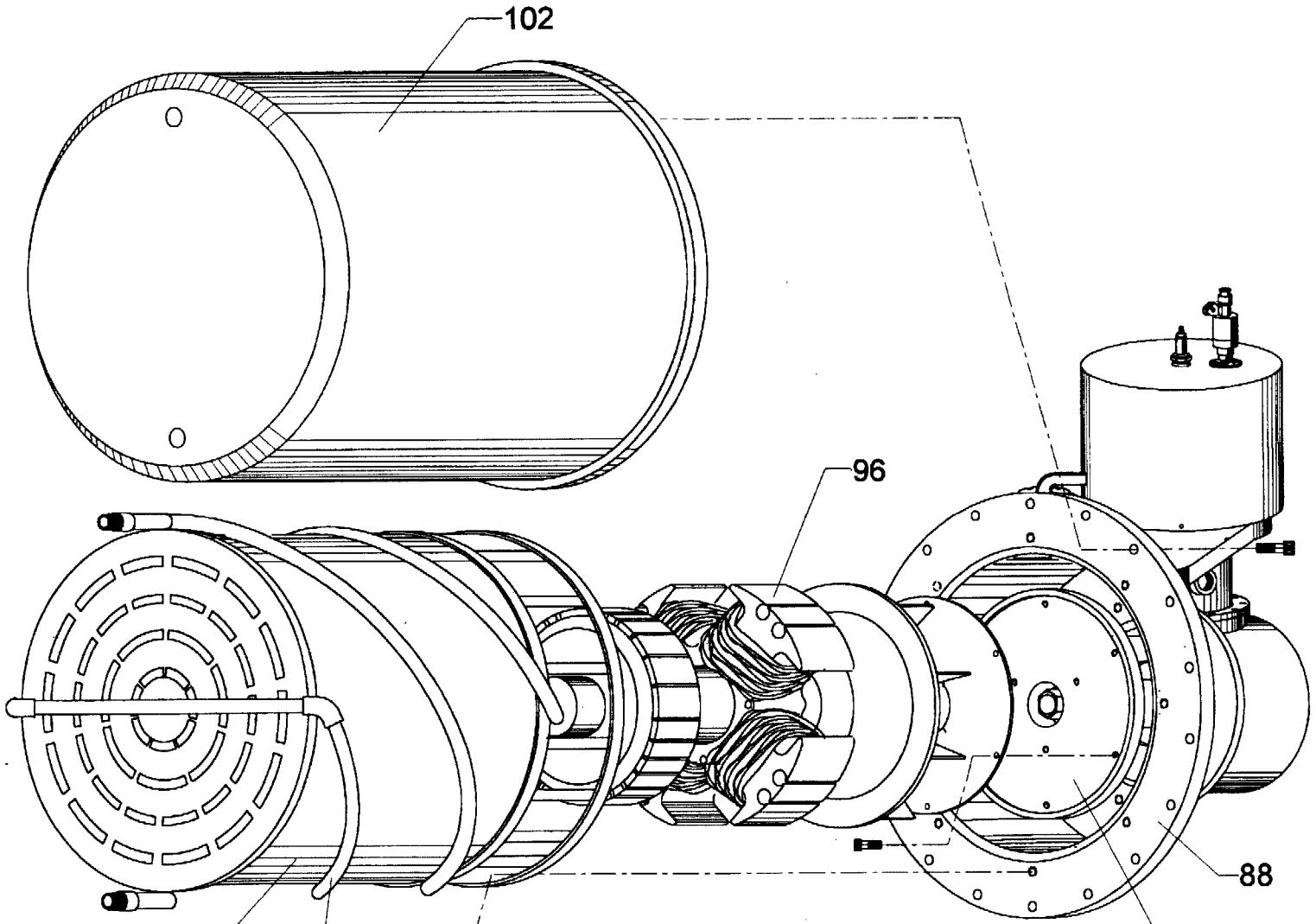
FIG. 7 is an exploded isometric view of the generator components and housing of the Stirling engine generator system of FIG. 1.

FIG. 7 shows the Stirling engine assembly of FIG. 6 along with an exploded isometric view of the generator assembly. The generator assembly is made up of a generator armature 96 which is fastened to flywheel 94, and a generator stator 98, which is fastened to bell housing 88. A set of cooling tubes 100 surround the generator stator 98. These cooling tubes 100 are arranged such that they can pass through and be hermetically sealed to a generator housing 102, which is attached and sealed to bell housing 88.

Operation of the Invention

Referring to FIG. 2, air for combustion is introduced through air inlet duct 58 by a blower or other means and is forced to flow through passages within the recuperator 30 which are formed between the outer surface of the corrugated piece and the inner surface of the outer cylindrical shell. This combustion air picks up heat from the recuperator. The combustion air is then forced to enter the volume formed between the ceiling 106 and the inner surface of the air inlet duct 58, as can be seen by the arrows of FIG. 2. A small amount of the combustion air is forced to enter two small holes in the side of the vaporization tube 26. A metered amount of fuel is sprayed into the vaporization tube by the fuel injector 86. The hot vaporization tube vaporizes the fuel as it is mixed with the air entering the tube. As this fuel-air mixture exits the vaporization tube, it is met by the bulk of the combustion air which passes through the opening in the ceiling 106 and is set into a swirling motion by the air deflector 28. At the point of departure of the air fuel mixture from the vaporization tube, a high voltage spark is formed between the igniter 24 and the end of the vaporization tube. Combustion occurs at this point and the combustion gasses are directed to flow past the tubes and domed section of the heater assembly 32, by the liner 64. These combustion gasses are then forced to flow through the passages of the recuperator 30 formed between the inner surfaces of the corrugated piece and the inner cylindrical shell, thus heating the incoming combustion air and cooling the out-going combustion gasses. A constant temperature of the working gas within the heater assembly can be maintained by regulating the fuel flow and the air flow by the use of pulse width modulation of the fuel injector and voltage control of the blower motor by a micro-computer or other suitable means. Complete combustion of the fuel can be achieved with "blue flame" combustion from many liquid combustible fuels, such as a diesel, gasoline, alcohol, gasohol, or kerosene. Because there is an abundance of incoming air at atmospheric pressure, the level of unburned hydrocarbons is low as well as producing low carbon monoxide levels.

In order to set the crankshaft 16 into motion, the starter system of FIG. 6 is employed. It consists of a permanent magnet rotor which is fastened to the flywheel 94. The starter stator 90 which is rigidly fastened to the bell housing 88, receives electrical pulses from a battery or other means, through an electronic circuit according to the input from the optical speed sensor 82. Light beams are intermittently interrupted within the sensor by the speed sensor disk, in such a way as to provide commutation of the electrical field in the stator causing the rotor to rotate and thus the crankshaft 16 also to rotate. When the crankshaft rotates in a counterclockwise fashion as seen in FIG. 2, the compression piston 14 moves upward and the expansion piston 12 moves to the left The working gas that is contained within the system is forced to move from above the compression piston through the cooler 20 and the regenerator 22, and into the heater assembly 32. The working gas picks up heat from the hot surfaces of the heater assembly and expands, forcing the expansion piston down. The dome 74 which is constructed of a fibrous ceramic material provides thermal insulation from the working gas and keeps the expansion piston from over heating.

As the crankshaft continues to rotate in a counter clockwise fashion, the two pistons continue their 90 degree phase relation movement within the cylinders. As the expansion piston begins to move from left to right, the working gas is forced through the heater assembly into the regenerator where some of its heat is stored in metallic filaments contained within it. The gas then passes through the cooler around its cooling tubes. Water is pumped through these tubes and also around the compression cylinder 34, within its water jacket The working gas gives up a significant amount of its heat in these areas. As the crankshaft continues to rotate, the compression piston moves upwardly compressing the working gas, and also moving it back through the system to the heater assembly. As it passes through the regenerator it regains some of the heat that it stored there on its way through previously. As this process continues, moving the gas back and forth between the compression side where it is compressed and the expansion side where it expands, speed of rotation increases due to the work done on the pistons by the working gas. Once a predetermined speed is reached, the electrical pulses to the starter are discontinued. After this happens, the starter becomes an alternator whose output can be rectified and used to charge the battery used to start the engine.

In order to regulate the angular velocity of the crankshaft and therefore the velocity of the generator armature which is fastened to it, it is necessary to regulate the pressure of the working gas within the working space. This space is defined by the volume within the cylinders as bounded by the pistons and the volume contained within the heater assembly, the regenerator, and the cooler. As the compression piston moves up and down within the larger diameter portion of the compression cylinder, it carries with it the compressor piston 38 which moves up and down within the smaller diameter section of the compression cylinder. During the "up stroke" the reed type compressor valve 50, is forced closed by the increasing pressure of the working gas trapped above the compressor piston. This increased pressure forces open the ball valve 40 within the compressor piston, allowing gas to move through the piston and into the space below it which is part of the working space. As the compressor piston begins to move back down the cylinder, the pressure above it decreases, opening the compressor valve 50 and closing the ball valve 40. This decreased pressure draws helium gas through the compressor tube from the "buffer" space. This space is made up of the interior volumes of the crankcase 10, the bell housing 88, and the generator housing 102. As the compressor piston continues its up and down motion, it continues to increase the pressure of the working space and decrease the pressure of the buffer space. This increase in pressure of the working space causes an increase in the rotational velocity of the engine.

Once the proper velocity is reached as determined by the micro-computer, which is receiving input from the speed sensor 82, (previously used as the starter commutator), a signal is sent to the pressure control valve 52. This valve can be either a proportional valve or a pulse-width modulated solenoid valve. As the pressure control valve is opened, working gas is allowed to flow through the pressure control tube 54 which connects the upper portion of the compression cylinder and the crankcase. This allows the pressure of the working space to be decreased. A constant rotational velocity can then be achieved by regulating the flow through the pressure control valve, thus offsetting the increase in pressure caused by the compressor piston. To achieve closed loop control of this speed regulation a pressure sensor can be added to the system.

In order for a system with this simplicity to function properly, it is imperative that no lubricating oil enter the working space. Such oil would form a carbon build-up within the heater assembly and the regenerator. The best way to ensure that no oil enters the working space is to eliminate it entirely. To do this requires a careful selection of materials and relationships of parts within the engine. For both the expansion and compression pistons, a special flame sprayed coating consisting of ceramic and PTFE is applied. This eliminates wear and provides a dry lubrication between the pistons and the cylinder walls. A glass fiber reinforced and PTFE impregnated material is used for the piston rings 62. High temperature lubrication and seals are used in the self lubricated and permanently sealed main bearings 78. The journal type connecting rod bearings 72 are constructed of a graphite and PTFE filled sintered polyimide. This material is self lubricating and can be operated at temperatures of 500 degrees F., eliminating the need for lubrication or crankshaft cooling.

To prevent overheating of the expansion piston and its piston rings, the expansion cylinder is constructed in a way which allows the portion where the piston and its rings travel to be water jacketed, and therefore cooled, while the heater assembly, which forms the outer (away from the crankshaft) portion of the cylinder and cylinder head, remains hot and is thermally insulated from the expansion cylinder by a synthetic asbestos material. Insulating the expansion piston from the hot working gas is the fibrous ceramic dome which is solid but porous and has a rigid outer ceramic layer. This material can stand extremely high temperatures, has a very low coefficient of thermal conductivity, and has a density sufficiently low as to allow its weight to be nearly equal to that of the compressor parts that are attached to the compression piston, resulting in a system that is balanced.

Conclusions, Ramifications, and Scope of the Invention

It can be seen that the Stirling engine generator system of this invention provides a highly reliable, quiet, efficient and easy to manufacture, therefore economical system. It is constructed with components which are readily available in the industry such as automotive style crankshaft, pistons, connecting rods and a conventional rotary generator. It has overcome many of the problems associated with conventional internal combustion engine driven generators, including vibration, noise, pollution, and the consumption of expendable items such as lubricating oil and filters, fan and alternator belts, alternator and starter brushes, and mufflers. The present invention also overcomes many of the problems found with previously disclosed Stirling engine systems, namely loss of working fluid, complex control systems, dynamic balancing, and oil contamination of heaters and regenerators.

While the above specification contains many specificities, these should be regarded as illustrative rather than restrictive, and should not be construed as limitations on the scope of the invention, but rather as an exemplification of one preferred embodiment thereof. Variations and changes may be made by those skilled in the art without departing from the spirit of the invention. For example a double acting Stirling engine could employ secondary pistons mounted inline with and connected to the present pistons with rigid connecting rods which pass through an opening in an intermediate bulkhead which separates the present cylinders with an extension of same. This would achieve essentially a doubling of the power output with little modification of the components. Similarly, four or more cylinders could be employed either in line with the present cylinders or radially around the crankcase, again doubling the power output.

It is well known that many heat sources can be used to power a Stirling cycle engine, such as solar power. The replacement of the burner assembly of the present invention with a solar collector or any other heat source would not detract from the scope of the invention.

It is also well known that a Stirling cycle engine can be used as a heat pump by simply running it "backwards". In other words supply input power to an electric motor which replaces the generator of the present invention and receive heat and cold as an output. It also should be noted that if the generator of the present invention were replaced with another identical Stirling engine, the result would be an efficient liquid fuel (or solar) powered refrigeration system.

Other embodiments of the present invention could include a swash plate drive, a rhombic drive or a system with cylinders essentially inline with a crankshaft with a ninety degree angle between two lobes.

Accordingly, the scope of the invention should be determined not by the embodiment illustrated, but by the appended claims and their legal equivalents.

What I claim is:

1. A Stirling cycle engine driven generator, said generator being operatively connected to an external load or source, said Stirling cycle driven generator comprising:

a sealed housing, said housing being filed with a gaseous fluid, said gaseous fluid being pressurized to a pressure above atmospheric pressure;

a compression piston having a first side and a second side opposite said first side movably mounted within said housing, said compression piston being in sealed engagement with said housing and restricting the passage of said gaseous fluid between said first side of said compression piston and said second side of said compression piston;

an expansion piston having a first side and a second side opposite said first side movably mounted within said housing, said expansion piston being in sealed engagement with said housing and restricting the passage of said gaseous fluid between said first side of said expansion piston and said second side of said expansion piston; a mechanical connection means which connects said second side of said expansion piston and said second side of said compression piston in such a way as to cause oscillatory movement of said expansion piston and said compression piston, the relative movement of said pistons defining a phase angle, said phase angle being essentially 90 degrees;

said mechanical connection means further containing a rotatably mounted member which rotates in concert with the said oscillatory movement of said pistons; a compression space within said housing having one side defined by said first side of said compression piston, said compression space containing a working fluid; an expansion space within said housing having one side defined by said first side of said expansion piston, said expansion space containing said working fluid, said working fluid being the same material as said gaseous fluid;

said expansion space and said compression space being in communicating relationship so as to allow said working fluid to flow between said expansion space and said compression space in response to said oscillatory movement of said expansion piston and said compression piston;

a cooler in a heat transferring relationship with said working fluid in said compression space;

a heater in a heat transferring relationship with said working fluid in said expansion space;

a generator armature rotatably mounted within said housing, said armature connected to said rotatably mounted member of said mechanical connection means;

a generator stator mounted within said housing in such a way as to act in conjunction with said armature so as to produce electrical current when said armature rotates.

2. A Stirling cycle engine driven generator according to claim 1 further comprising a regenerator in a heat transferring relationship with said working fluid such that heat is stored in said regenerator while said working fluid travels from said expansion space to said compression space and heat is regained by said working fluid from said regenerator as said working fluid travels from said compression space to said expansion space whereby efficiency is improved.

3. A Stirling cycle engine driven generator according to claim 1 wherein said mechanical connection means is a crankshaft.

4. A Stirling cycle engine driven generator according to claim 3 wherein said mechanical connection comprising self lubricated journal bearings.

5. A Stirling cycle engine driven generator according to claim 4 wherein said self lubricated journal bearings contain PTFE filled polyimide.

6. A Stirling cycle engine driven generator according to claim 1 wherein said compression piston and said expansion piston are coated with a flame sprayed coating containing ceramic and PTFE.

7. A Stirling cycle engine driven generator according to claim 6 wherein a fibrous ceramic dome is affixed to said first side of said expansion piston.

8. A Stirling cycle engine driven generator according to claim 7 wherein said pumping means includes a compressor piston connected to said compression piston.

9. A Stirling cycle engine driven generator according to claim 8 wherein said compressor piston includes a valve.

10. A Stirling cycle engine driven generator according to claim 1 further comprising a pumping means for moving said gaseous fluid contained within said housing from said second side of said compression piston to the said first side of said compression piston whereby pressure is increased in said working fluid.

11. A Stirling cycle engine driven generator according to claim 10 further comprising a valving means for controlling the flow of said working fluid from the said compression space to said housing whereby the pressure of said working fluid is regulated.

12. A Stirling cycle engine driven generator according to claim 11 wherein said valving means contains a proportional control valve and a microprocessor controller.

13. A Stirling cycle engine driven generator according to claim 1 further comprising a pumping means for moving said gaseous fluid contained within said housing from said second side of said expansion piston to the said first side of said expansion piston whereby pressure is increased in said working fluid.

14. A Stirling cycle engine driven generator according to claim 1 further comprising a self starting means.

15. A Stirling cycle engine driven generator according to claim 14 wherein said self starting means is used to generate an electrical current while said Stirling cycle engine is in operation.

16. A Stirling cycle engine driven generator according to claim 14 wherein said self starting means comprises a starter stator and a starter rotor, with said starter stator affixed to said housing and said starter rotor rotatably connected to said mechanical connection means.

17. A Stirling cycle engine driven generator according to claim 16 wherein said starter stator and said generator stator are one and the same and said starter rotor and said generator armature are one and the same.

18. A Stirling cycle engine driven generator according to claim 16 further comprising an electronic commutation means for supplying electrical current to said stator.

19. A Stirling cycle engine driven generator according to claim 18 wherein said commutation means includes a sensing means selected from the group consisting of optical sensors, Hall effect sensors, capacitive sensors, proximity sensors and magnetic sensors.

20. A Stirling cycle engine driven generator according to claim 1 wherein the said heater comprises a plurality of passages for containing and transporting said working gas;

a domed shaped cylinder head connected to said passages;

a cylindrical shell for directing combustion gasses past said passages and said cylinder head;

an annular recuperator having inlet air channels and exhaust gas channels with inlets and exits of said channels at both ends;

an exhaust duct which communicates with said exhaust gas channels of said recuperator;

an inlet air duct which communicates with said inlet air channels of said recuperator such that incoming air is heated by said exhaust gasses;

a vaporization tube which communicates with said inlet air duct;

an electronic fuel injector which communicates with said vaporization tube, and an igniter positioned a predetermined distance from said vaporization tube, whereby said fuel injector injects fuel through the said vaporization tube where it is heated and mixed with air before exiting said vaporization tube where it is ignited and burned by said igniter.

* * * * *